United States Patent [19]

Rasmussen et al.

[11] Patent Number: 4,775,354

[45] Date of Patent: Oct. 4, 1988

[54] COIN SORTING APPARATUS WITH ROTATING DISC STATIONARY GUIDE PLATE FOR SORTING COINS BY THEIR DIFFERENT DIAMETERS

[75] Inventors: James M. Rasmussen, Chicago; Douglas U. Mennie, Barrington, both of Ill.

[73] Assignee: Cummins-Allison Corp., Mt. Prospect, Ill.

[21] Appl. No.: 66,959

[22] Filed: Jun. 29, 1987

[51] Int. Cl.[4] ..... G07D 3/06

[52] U.S. Cl. ..... 453/10

[58] Field of Search ..... 453/3, 6, 9, 10, 12, 453/13; 221/167, 168, 169

[56] References Cited

U.S. PATENT DOCUMENTS

| | | | |
|---|---|---|---|
| 4,543,969 | 10/1985 | Rasmussen | 453/10 |
| 4,564,037 | 1/1986 | Childers et al. | 453/6 |
| 4,570,655 | 2/1986 | Raterman | 453/10 |

FOREIGN PATENT DOCUMENTS

| | | | |
|---|---|---|---|
| 0149906 | 7/1985 | European Pat. Off. | 453/6 |

*Primary Examiner*—Joseph J. Rolla
*Assistant Examiner*—Edward S. Ammeen
*Attorney, Agent, or Firm*—Stephen G. Rudisill

[57] ABSTRACT

A coin sorter for sorting coins in terms of their diameter includes a referencing wall engaging the radially outer edges of the coins as they are advanced circumferentially so that the radially outer edges of the coins are positioned at a preselected radial location, whereby the radially inner edges of the coins are positioned at different radial locations determined by the diameters of the respective coins. A series of circumferentially spaced exit recesses are formed around the outer periphery of a guide plate with the radially inner edges of the inner ends of successive exit recesses located at different radial positions for receiving the inner portions of coins of progressively increasing diameter. A ramp at the inlet end of each of the exit recesses slopes from the lowermost surface of the guide plate at the inlet end of the exit recess upwardly to the top surface of the exit recess for easing coins into the exit recess under the pressure of a resilient surface. The ramps preferably have a width that is less than half the width of the exit recess. A portion of the inner recess adjacent the inlet end of the spiral recess, and extending across the inlet end of the spiral recess, is spaced farther from the top surface of the disc than the lowermost surface of the guide plate but closer to the top surface of the disc than the upper surface of any pair of stacked coins carried by the disc.

9 Claims, 3 Drawing Sheets

COIN SORTING APPARATUS WITH ROTATING DISC STATIONARY GUIDE PLATE FOR SORTING COINS BY THEIR DIFFERENT DIAMETERS

FIELD OF THE INVENTION

The present invention relates generally to coin sorting devices and, more particularly, to coin sorters of the type which use a disc having a resilient surface rotating beneath a stationary sorting head for sorting coins of mixed denominations.

SUMMARY OF THE INVENTION

It is a primary object of the present invention to provide an improved coin sorter of the foregoing type which reduces the time required to machine the sorting head or guide plate, thereby reducing the cost of manufacturing the sorter.

It is another object of this invention to provide an improved coin sorter which reduces the wear on the resilient surface of the rotating disc.

Other objects and advantages of the invention will be apparent from the following detailed description of the accompanying drawings.

DESCRIPTION OF THE PREFERRED EMBODIMENT

Figure 1:
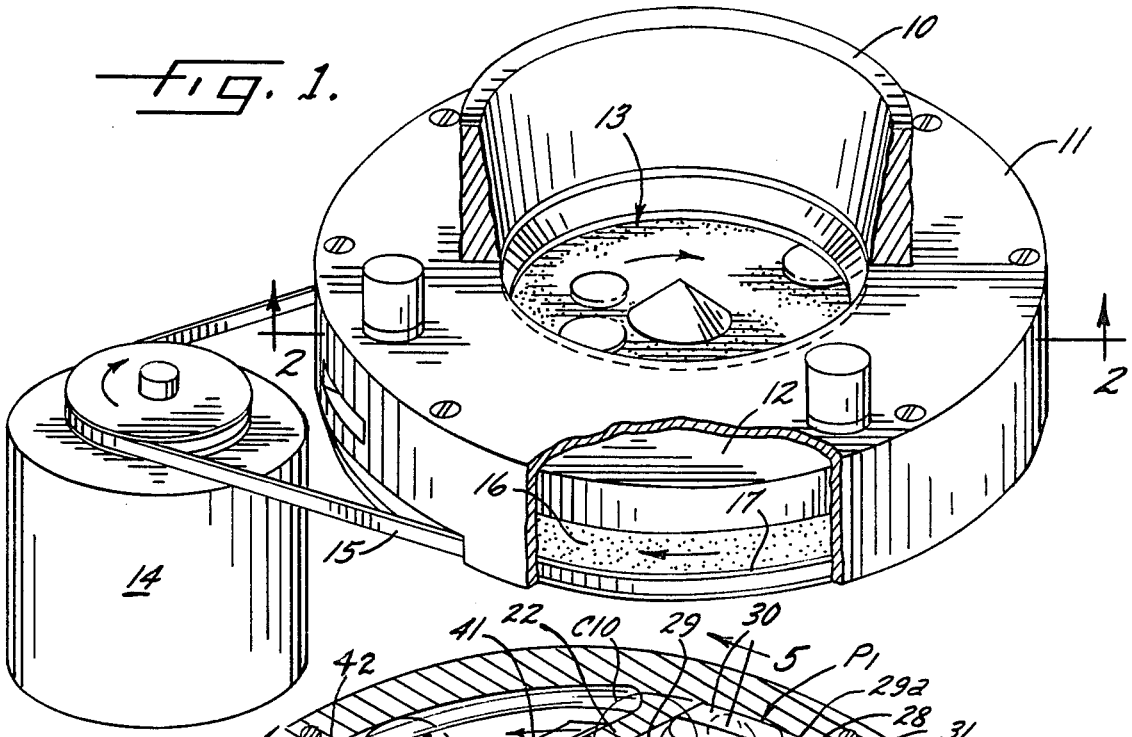
FIG. 1 is a perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through central openings in a housing 11 and a annular sorting head or guide plate 12 inside the housing. As the coins pass through these openings, they are deposited on the top surface of a rotatable disc 13. This disc 13 is mounted for rotation on a stub shaft (not shown) and driven by an electric motor 14 via drive belt 15. The disc 13 comprises a resilient pad 16 bonded to the top surface of a solid metal disc 17. The top surface of the resilient pad 16 is preferably covered with a durable fabric bonded to the pad itself, which is preferably made of a resilient rubber of polymeric material.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is slightly greater than the thickness of the thickest coin.

Figure 2:
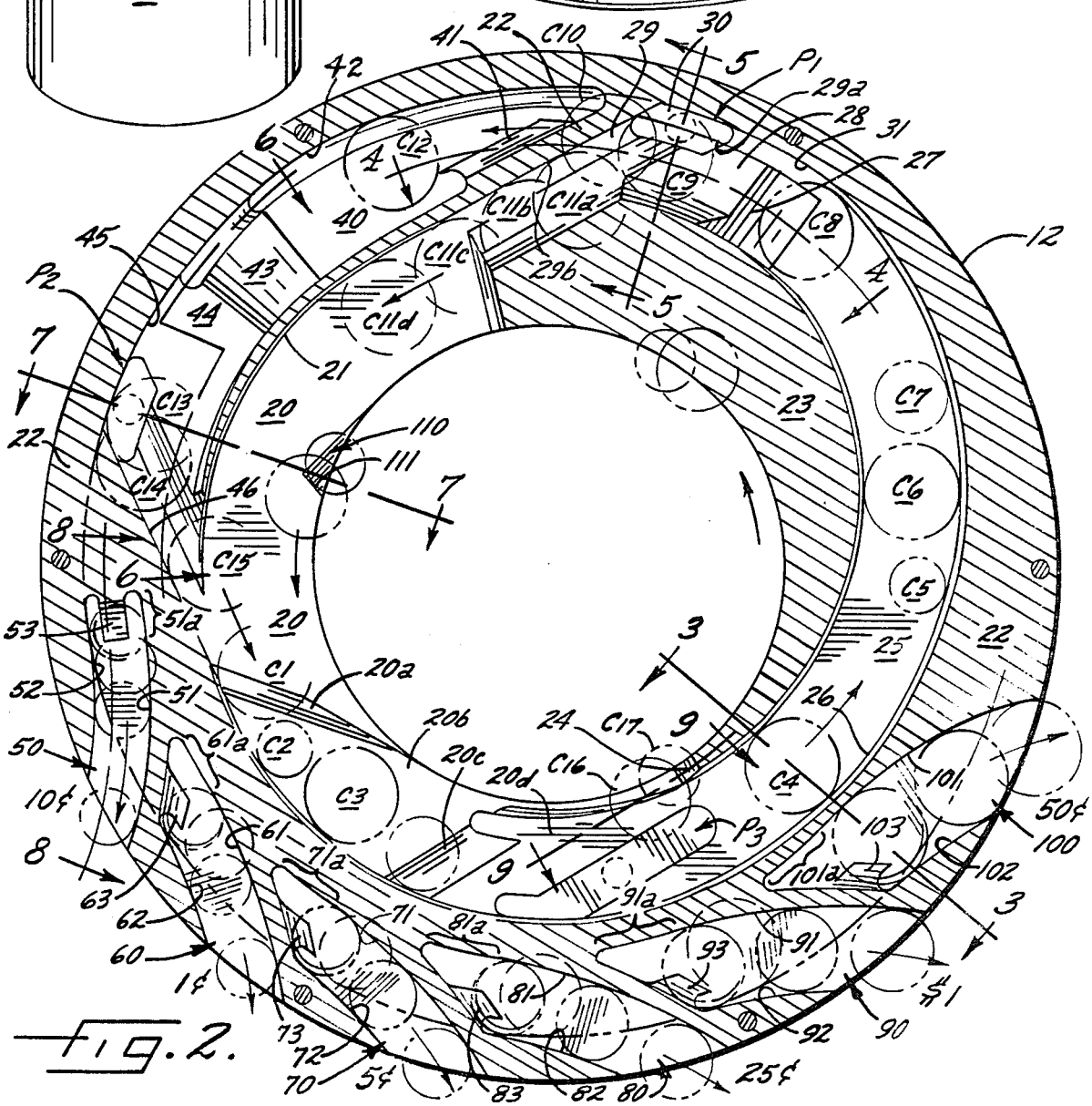
FIG. 2 is an enlarged horizontal section taken generally along the line 2—2 in FIG. 1 to show the configuration of the underside of the sorting head or guide plate, with hatching added to the uppermost surface of the guide plate to more clearly identify the recessed areas, and with various coins superimposed thereon to illustrate the functions of the guide plate.

As can be seen most clearly in FIG. 2, the outwardly moving coins initially enter an annular recess 20 formed in the underside of the guide plate 12 and extending around a major portion of the inner periphery of the annular guide plate. Coins C1, C2 and C3 superimposed on the bottom plan view of the guide plate in FIG. 2 are examples of coins which have entered the peripheral recess 20. The outer wall 21 of the recess 20 extends downwardly to the lowermost surface 22 of the guide plate, which is spaced from the top surface of the pad 16 by a distance which is slightly less than the thickness of the thinnest coins; for example, the gap between the plate surface 22 and the pad 16 is typically 0.010 inch, which is less than the 0.053-inch thickness of a dime. Consequently, radial movement of the coins via centrifugal force is terminated when they engage the wall 21 of the recess 20, though the coins continue to move circumferentially along the wall 21 by the rotational movement of the pad 16, as indicated by the arrows in FIG. 2. (For clarity, hatching has been added to the entire lowermost surface 22 in FIG. 2.)

Figure 7:
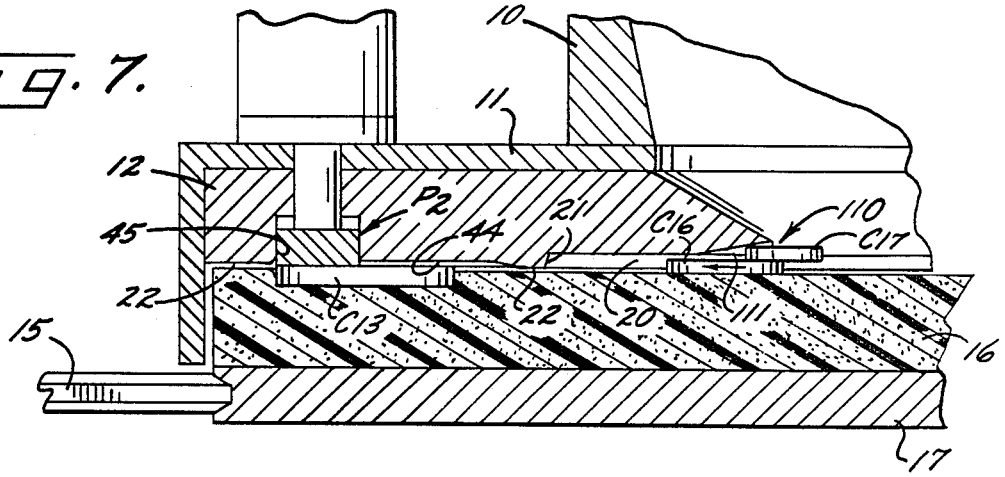
FIG. 7 is an enlarged section taken generally along line 7—7 in FIG. 2.
Figure 8:
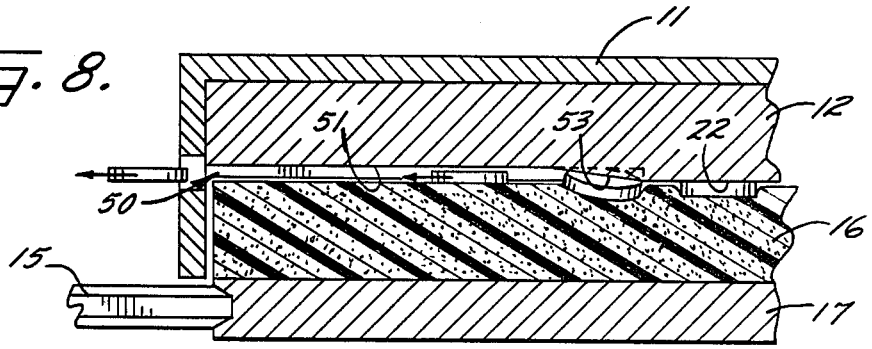
FIG. 8 is an enlarged section taken generally along line 8—8 in FIG. 2.

As can be seen in FIG. 7, the outer wall of the recess 20 is tapered to minimize abrasion and coin bounce.

Because the recess 20 is deep enough to accept the thickest coin, the thinner coins may be stacked on one another within this recess. To help eliminate such stacking of the thinner coins, the recess 20 includes a ramp **20*a* leading to a region 20*b* which is more shallow than the remainder of the recess 20. This shallower region 20*b* engages the top surfaces of any stacked coins passing through that region so as to restore the coins to a single layer. That is, the stacked coins are pressed into the resilient pad 16 so that the pad tends to drag the lower coin away from the upper coin (the greatest coefficient of friction is at the interface of the lower coin and the surface of the pad 16). The region 20*b* is sufficiently shallow to allow only a single layer of distribution of thin coins to enter this region directly from the central open area of the guide plate. Because of the shallowness of the region 20*b*, the thicker coins cannot directly enter the region 20*b* from the center of the guide plate, but must first enter the deep region of the recess 20 and then be eased into the region 20*b* via the ramp 20*a***.

From the region **20*b*, the coins pass over a second ramp 20*c* into a region 20*d* which has the same depth as the initial portion of the recess 20. A circumferential extension of the region 20*b* along the inner edge of the guide plate ensures that stacked or shingled coins in the central open area of the guide plate cannot enter the region 20***d*.

The only portion of the central opening of the guide plate 12 which does not open directly into some region of the recess 20 is that sector of the periphery which is occupied by a raised land 23 whose surface is coplanar with the lowermost surface 22 of the guide plate. As coins within the recess 20 approach the leading edge 24 of the land 23, those coins move outwardly around the land 23 through a spiral recess 25 which is an outward extension of the inner peripheral recess 20. In FIG. 2, coins C4, C5, C6 and C7 are examples of coins moving in succession through the recess 25, which is wide and deep enough to accommodate coins of all denominations.

Figure 3:
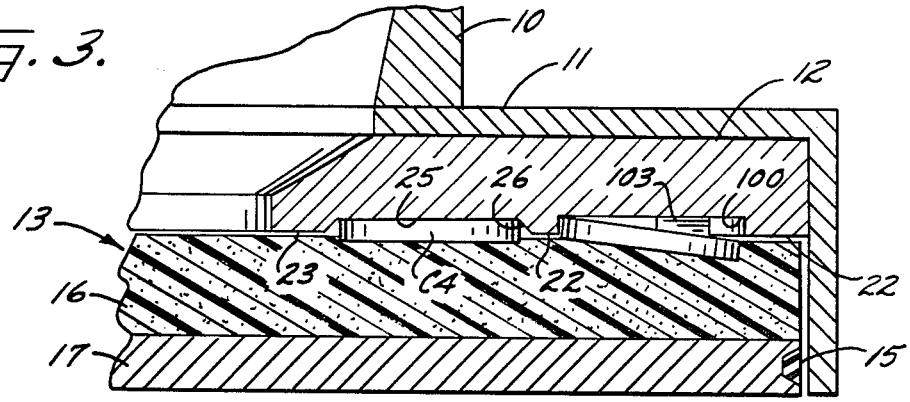
FIG. 3 is an enlarged section taken generally along line 3—3 in FIG. 2.

Just as the spiral recess 25 is an extension of the peripheral recess 20, the outer wall 26 of the recess 25 is an extension of the outer wall 21 of the recess 20. Thus, coins which approach the recess 25 with their outer edges riding on the wall 21 move into the recess 25 with their outer edges riding on the outer wall 26, as illustrated by coins C4–C7 in FIG. 2. As can be seen in the sectional view in FIG. 3, the wall 26 is preferably tapered to minimize abrasion by reducing the area of contact between the coins and the recess wall.

Figure 4:
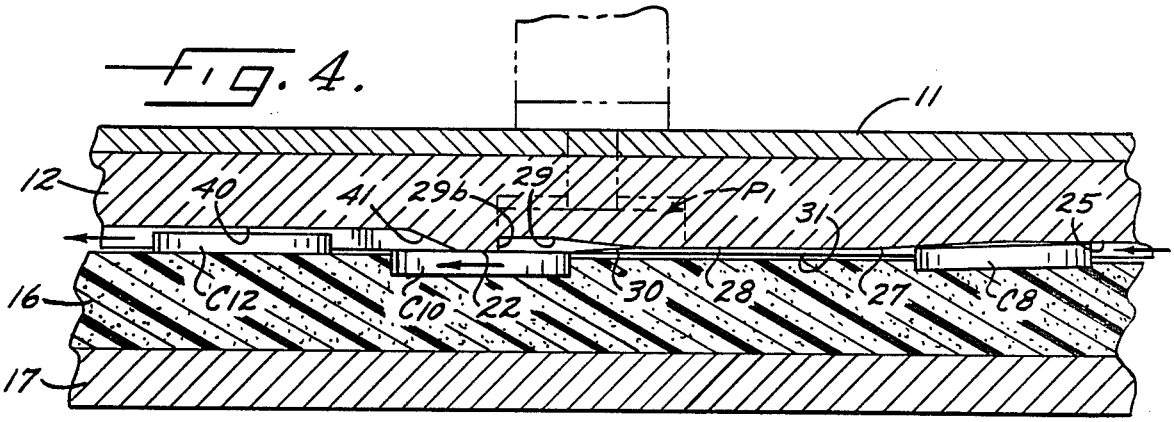
FIG. 4 is an enlarged section taken generally along line 4—4 in FIG. 2.

Rotation of the pad 16 continues to move the coins along the wall 26 until those coins engage a ramp 27 sloping downwardly from the top surface of the recess 25 to a region 28 (see the sectional view in FIG. 4). Coin C8 in FIG. 2 is an example of a coin which has just engaged the ramp 27. Because the region 28 is spaced from the pad 16 by a distance that is less than the thickness of the thinnest coin, the effect of the ramp 28 is to depress any coin that engages the ramp downwardly into the resilient pad 16 as the coins are advanced along the ramp by the rotating disc. As can be clearly seen in FIG. 4, this causes the coins to be urged against the guide plate surface region 28 by resilient pad 16.

As the coins move along the recess 25, centrifugal force causes the coins to engage the outer wall 26 of this recess. Occasionally, however, a coin will be blocked from movement to the outer wall by other coins, so that the blocked coin will continue to be moved through the recess 25 but will not be in single file with all the other coins. To remedy this problem, the region 28 leads to an inclined return recess 29 whose outermost edge 29*a* is spaced inwardly from the outboard edge 26 of the recess 25. Consequently, coins which never reach the outer wall 26, and thus are not in single file with the other coins, are intercepted by the recess 29 and guided inwardly by the wall 29*b* until they are returned to the peripheral recess 20. The return movement is illustrated by coins C11*a*-11*d* in FIG. 2, and the profile of the recess 29 is shown in the sectional view in FIG. 4. The returned coins are recycled through the recess 20 and back into the recess 25 where they hopefully will be able to reach the outer wall 26 to become part of the desired single file of coins.

The particular sorting head illustrated in the drawings includes several retractable plungers which are used to quickly stop the flow of coins along their normal paths when one of the receptacles located outboard of the exit recesses has been filled with the desired number of coins. This is commonly referred to as a "bag stop" feature, and is described in more detail in U.S. Pat. No. 4,570,655. In the particular embodiment illustrated here, the sorting head includes three bag stop plungers P1, P2 and P3. It will be noted that the plunger P1 is located at the outer end of the return recess 29, and actually forms the outer edge 29*a* of this recess.

Figure 5:
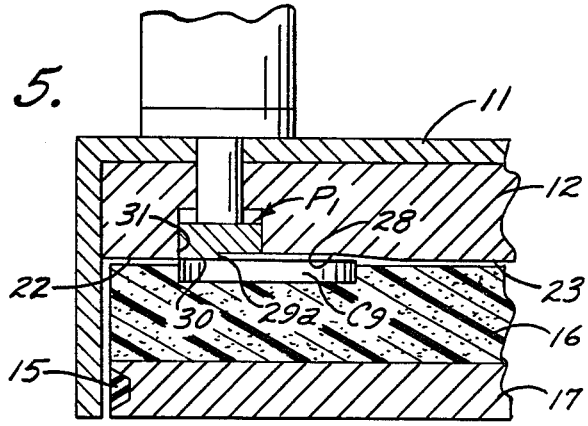
FIG. 5 is an enlarged section taken generally along line 5—5 in FIG. 2.

When the plunger P1 is in its advanced (lower) position, the outboard portion 30 of the plunger surface provides a smooth transition from the region 28 to the lowermost surface 22 of the guide plate (see FIG. 5). Consequently, those coins whose outer edges are engaging or close to the wall 26 are prevented from entering the return recess 29 by riding over the outboard portion 30 of the plunger, as illustrated by coins C9 and C10 in FIG. 2. Only those coins whose outer edges are spaced far enough away from the wall 26 to miss the plunger portion 30 are intercepted by the recess 29 and recycled. Precise radial positioning of those coins which are close enough to the wall 26 to engage the plunger portion 30 but nevertheless spaced away from the wall 26 is effected by a subsequent portion of the guide plate to be described below.

When the plunger P1 is in its retracted (upper) position, all coins are intercepted by the return recess 29 and recycled. This is part of the aforementioned "bag stop" feature.

The guide plate surface region 28 between the ramp 27 and the return recess 29 is slightly recessed from the lowermost surface 22 to form an outer wall 31 which prevents coins from moving outwardly to the periphery of the guide plate. This edge 31 can be seen most clearly in FIGS. 4 and 5. When the plunger is in its retracted position, causing all coins to be recycled by the return recess 29, a number of coins can accumulate in the region 28. The pressure of the accumulating coins on each other can tend to urge certain of the coins outwardly, but the wall 31 formed by the slight recess of the region 28 prevents such coins from escaping to the outer periphery of the sorting head.

In the sorting mode of the machine, when the plunger P1 is in its advanced (lower) position, the single file of coins transversing the ramp 27 and the plunger portion 30 enters a referencing or "gauging" recess 40 by way of a ramp 41 sloping upwardly from the lowermost plate surface 22 to the top surface of the recess 40. The top surface of this gauging recess 40 is spaced away from the top of the pad 16 by a distance which is greater than the thickness of the thickest coin, so that the coins are free to move in a radial direction within this recess via centrifugal force. The outer wall 42 of the referencing recess 40 has a slightly larger radius from the center of the guide plate than the wall 26. Consequently, all the coins which enter the recess 40, including those that were slightly spaced from the wall 26 as well as those that engaged the wall 26, move radially outwardly by centrifugal force within the recess 40. This outward movement brings all the coins into engagement with the outer wall 42 of the gauging recess 40, as illustrated by coin C12 in FIG. 2. Thus, the outer edges of all the coins are aligned at a common radial location. That is, free outward movement of the coins within the recess 40 insures that the outer edges of all the coins are located at a common radial position, regardless of where the outer edges of those coins were located when they were initially captured by the ramp 27. With the outer edges of the coins thus aligned at a common radial position, the inner edges of the coins of each different denomination are located at a radial position unique to that particular denomination. As will be described below, these unique radial positions of the inner edges of the coins of different denominations are utilized to sort the coins.

Figure 6:
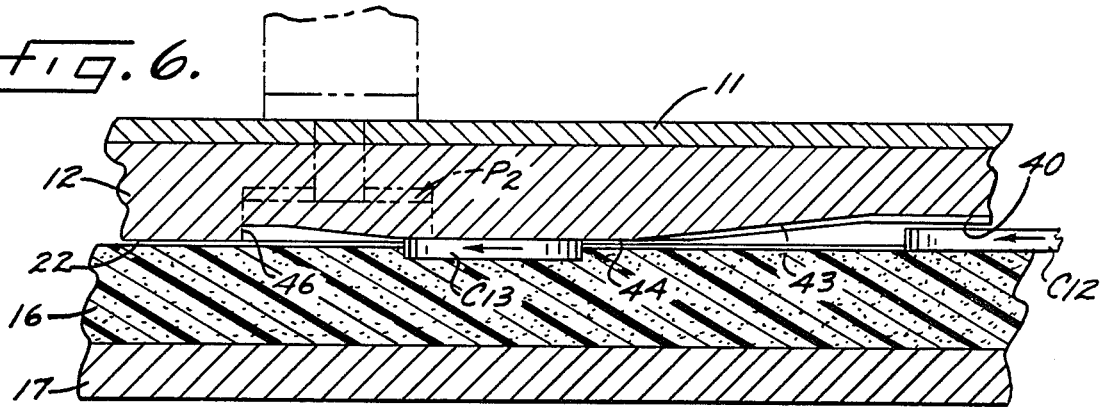
FIG. 6 is an enlarged section taken generally along line 6—6 in FIG. 2.

At the downstream end of the gauging recess 40, a ramp 43 slopes downwardly from the top surface of the recess 40 to a region 44 which is spaced from the pad 16 by a distance that is less than the thickness of the thinnest coin. Thus, the coins are once again urged against the guide plate 12 by the resilient pad 16, as illustrated in the sectional view in FIG. 6. This ensures that the coins are held securely in the new radial position determined by the wall 42 of the gauging recess 40. From this point forward, the coins remain gripped between the guide plate 12 and the resilient pad 16 as the coins are advanced along a series of six arcuate exit recesses 50, 60, 70, 80, 90 and 100 spaced circumferentially around the outer periphery of the guide plate.

The region 44 is where the second "bag stop" plunger P2 is located. When this plunger P2 is in its advanced (lower) position, the lower surface of the plunger provides a smooth transition between the slightly recessed region 44 and the lowermost guide plate surface 22. This is the position of the plunger P2 during the normal coin sorting mode. When the plunger P2 is in its retracted (upper) position, all the coins emerging from the gauging recess 40 are intercepted by a return recess 46 and recycled, thereby clearing the guide plate of circulating coins while no coins are being discharged.

The region 44, like the region 28, is slightly recessed from the lowermost surface 22 to form an outer edge 45 which prevents coins from escaping to the outer periphery of the guide plate when the plunger P2 is retracted.

The six exit recesses 50, 60, 70, 80, 90 and 100 are positioned and dimensioned to receive dimes, pennies, nickels, quarters, dollars and half dollars, respectively. More specifically, the innermost edges 51, 61, 71, 81, 91 and 101 of the respective exit recesses 50, 60, 70, 80, 90 and 100 are positioned so that the inner edge of a coin of only one particular denomination can enter each recess, and each recess is wide enough to receive that particular denomination. As the coins of a given denomination enter one of the exit recesses, the coins of all other remaining denominations extend inwardly beyond the innermost edge of that particular recess so that the inner edges of those coins cannot enter that recess.

For example, only dimes have their inner edges spaced far enough away from the center of the guide plate to enter the first exit recess 50, and all other coins bypass the recess 50 because their inner edges remain gripped between the guide plate surface 22 and the pad 16. At the next exit recess 60, only pennies have their inner edges located far enough away from the center of the guide plate to enter the recess 60, and all the other coins bypass this recess because they still remain gripped between the guide plate surface 22 and the pad 16. Similarly, only nickels enter the recess 70, only quarters enter the exit recess 80, only dollars enter the exit recess 90, and half dollars enter the final exit recess 100. Thus, the coins are out-sorted in ascending order of their size (diameter).

To enhance the percentage of coins of the desired denominations captured by the respective exit recesses, the inboard edges of at least certain of the exit recesses have substantially constant radii at the inlets ends thereof. The remaining portions of the inboard edges of the exit recesses follow a path of increasing radius (from the center of the guide plate) to guide the captured coins to the outer periphery of the guide plate. Thus, as can be seen in FIG. 2, segment 51*a* of the inboard edge 51 of the exit recess 50 follows an arc of constant radius from the center of the guide plate. Consequently, dimes which are moving along a circumferential path on the guide plate surface 22 can be captured within the recess 50 anywhere along the length of the constant-radius segment 51*a* before the inboard wall of the recess starts to move radially outwardly to guide the dimes outwardly to the periphery of the guide plate for discharge at the desired circumferential positions. Similar constant-radius segments 61*a*, 71 *a*, 81*a*, 91*a*, and 101*a* are found at the inner ends of the inboard edges of the respective exit recesses 60, 70, 80, 90 and 100. A ramp 53 guides the dimes into the exit recess 50, and similar ramps 63, 73, 83, 93 and 103 are provided at the inlet ends of all the other exit recesses.

In accordance with the present invention, the ramps at the inlet ends of the exit recesses have a width, in the direction transverse of the direction of coin movement, that is less than half the width of the corresponding exit recess in the same transverse direction. This provides several advantages. First of all, the use of narrow ramps significantly reduces the machining time involved in manufacturing the guide plate. Coin sorters of the type described herein are capable of sorting thousands of coins per minute, and thus are subject to substantial abrasion by the thousands of coins which move along the guide plate at high velocities. Consequently, these guide plates are formed from hard steels, and the intricate configuration of recesses and wall configurations are typically formed by milling machines. Milling operations are relatively fast in forming recesses of uniform depth, but are much slower in forming sloping surfaces such as ramps because the milling tool must make a number of transverse passes at different depths to initially form a sort of staircase surface, after which the corners of the staircase are removed to form the desired smooth ramp. This is an extremely time-consuming operation, and forms a significant part of the total machining time.

With the ramp configuration provided by the present invention, the cumulative total number of inches of ramp surfaces to be machined is reduced by more than 50%, thereby greatly reducing the machining time and the resultant manufacturing cost of the guide plate.

By offsetting the ramps for at least the wider exit recesses toward the outboard edges of those recesses, the inboard sides of the exit recesses, which is where the inner edges of the coins are initially captured, are unobstructed by the ramp surface. Thus, the inner edges of the coins can be reliably captured by tilting the inner edges of the coins upwardly into the inboard portions of the exit recesses. The resilient pad on the surface of the rotating disc applies an upward pressure to the entire surface of the coin, but since the only support for that portion of the coin which has entered the exit recess is on the outboard half of the coin, the pad pressure causes the inboard half of the coin to tilt upwardly, pivoting about the narrow ramp as a fulcrum.

In the particular embodiment of the invention illustrated in FIG. 2, each of the entry ramps 53, 63, 73, 83, 93 and 103 is located in the outboard half of its exit recess. Consequently, the inside half of any coin engaging these ramps will extend beyond the inboard edge of the ramp, thereby enabling the resilient pad to tilt the inner edges of such coins upwardly into the inboard portions of the respective recesses. The outboard edges of all the ramps 53, 63, 73, 83, 93 and 103 are spaced away from the outboard edges 52, 62, 72, 82, 92 and 102 of the respective exit recesses to enable the milling tool which cuts the outer edges of the exit recesses to extend all the way to the ends of the recesses.

The inlet ends of the inboard edges of the exit recesses are preferably located at least as close to the inboard edge of the adjacent preceding exit recess as the inlet end of the outboard edge of that same recess. Referring specifially to the exit recess 60, which is the exit recess for the pennies, it can be seen that the inboard edge 61 of this recess begins at a point that is as close to the inboard edge 51 of the dime recess 50 as the outboard edge 62 of the penny recess. Consequently, the space between successive exit recesses is efficiently utilized to maximize the length of the inboard edges of the exit recesses while still maintaining a compact arrangement of the exit recesses in a sorting head having a relatively small outside diameter.

Returning now to the function of the land 23, the primary function of this portion of the guide plate 12 is to prevent two or more coins stacked on top of each other from entering the recess 25. When two or more coins are stacked on top of each other, they may be pressed into the resilient pad 16 even within the deep peripheral recess 20. Consequently, stacked coins can be located at different radial positions within the recess 20 as they approach the land 23. Coins C16 and C17 represent one example of such a pair of stacked coins.

Figure 9:
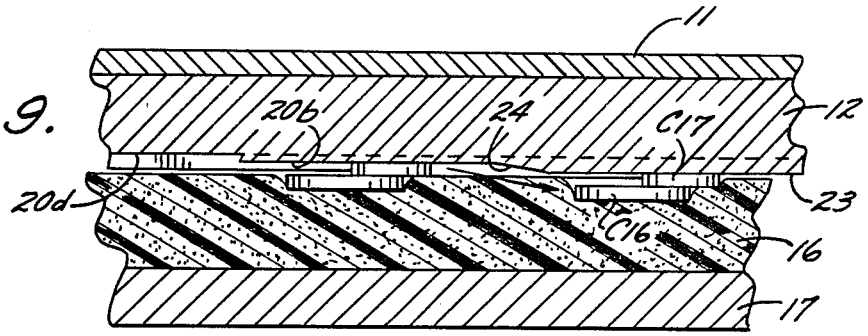
FIG. 9 is an enlarged section taken generally along line 9—9 in FIG. 2.

FIG. 9 illustrates what happens to a pair of stacked coins such as C16 and C17 as they engage the beveled leading edge 24 of the land 23. This beveled edge 24 pushes the stacked pair of coins down into the resilient pad 16, where they are held in a fixed radial position as they pass beneath the land 23. When these coins emerge from the trailing end of the land, they continue around the recess 20 until they engage a notch 110 formed in the inner periphery of the guide plate (see FIG. 2). When the stacked coins engage the notch 110, the upper coin engages the wall 111 of the notch, which retards the upper coin while the lower coin continues to be advanced by the rotating disc. Thus, the stacked coins are stripped apart so that they can once again enter the recess 20, this time in a single layer. The stripping action of the notch 110 is illustrated in the sectional view of FIG. 7.

The third bag-stop plunger P3 is located at the entrance to the recess 25 for blocking access to the recess 25 when the sorter is not operating in a sorting mode. Whereas the plungers P1 and P2 are in their advanced (lowered) positions when the sorter is operating in a sorting mode, the plunger P3 is in its retracted (upper) position during the sorting mode. This allows coins to freely enter the recess 25. When it is desired to block the entry of coins into the recess so that jamming does not occur, the plunger P3 is lowered to its advanced position, thereby guiding all the coins which pass through the recess 20 back into the central open area of the guide plate.

Figure 10:
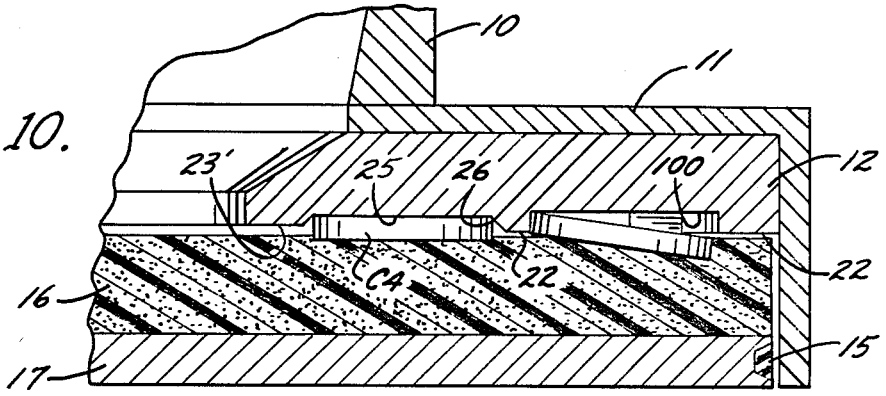
FIG. 10 is a section like the section of FIG. 3 but illustrating a modified embodiment of the invention.

In the modified embodiment shown in FIG. 10, the lower surface of the land 23' is slightly recessed so as to be spaced farther away from the resilient pad 16 than the lowermost surface 22 of the guide plate. The coins which pass under the land 23' are usually stacked pairs of coins, and thus they are depressed deeply into the pad 16 as they are rotated beneath the land. This can cause substantial abrasion of that portion of the pad 16 which passes under the land 23'. By recessing the surface of the land 23', this abrasion is reduced significantly. Of course, the distance between the land surface and the pad 16 is still less than the thickness of the thinnest coin.

What is claimed is:

1. A coin sorter for sorting coins in terms of their diameter comprising:

a rotatably mounted coin-carrying disc having a resilient top surface onto which coins may be fed;

means for rotating said disc to move the coins circumferentially;

a guide plate having a central opening and a lower surface positioned over and closely adjacent to said disc, and wherein said lower surface forms an inner recess within which coins are free to move radially, and said inner recess extends outwardly from said central opening, referencing means for engaging the radially outer edges of the coins as they are advanced circumferentially so that the radially outer edges of the coins are positioned at a preselected radial location, whereby the radially inner edges of the coins are positioned at different radial locations determined by the diameters of the respective coins, sorting means comprising a series of circumferentially spaced exit recesses have inner ends and are formed around the outer periphery of said guide plate with the radially inner edges of the inner ends of successive exit recesses located at different radial positions for receiving the inner portions of coins of progressively increasing diameter, said exit recesses having inboard and outboard edges, said exit recesses extending outwardly to the periphery of said guide plate so that the inner edges of the recesses guide the respective coins outwardly and eject those coins from between said disc and said guide plate, each exit recess having a width at least as great as the diameter of the coin denomination to be received therein, and a ramp at an inlet end of each of said exit recesses, each ramp sloping from the lowermost surface of said guide plate at the inlet end of the exit recess upwardly to the top surface of the exit recess for easing coins into the exit recess under the pressure of said resilient surface, the ramp for at least certain of said recesses having a width, in a direction transverse of the direction of coin movement, less than half the recess width in the same direction.

2. The coin sorter of claim 1 wherein each of said ramps is spaced away from both side edges of the discharge recess.

3. The coin sorter of claim 1 wherein said ramps for at least certain of said recesses are offset toward the outboard edge of the recess than the inboard edge.

4. The coin sorter of claim 1 wherein said ramps that have a width less than half the recess width include the ramp for the widest recess.

5. The coin sorter of claim 1 wherein the inboard edge of at least certain of said exit recesses have a segment at the inlet end thereof which has a substantially constant radius from the center of said disc for capturing coins which are being advanced along circumferential paths by said disc, said inboard edges then following a path of increasing radius from the center of said disc to guide the capture coins to the outer periphery of said guide plate.

6. The coin sorter of claim 1 wherein the inlet end of the inboard edge of at least certain of said exit recesses is located at least as close to the inboard edge of the adjacent preceding exit recess as the inlet end of the outboard edge of the same exit recess.

7. A coin sorter for sorting coins in terms of their diameter comprising:

a rotatably mounted coin-carrying disc having a resilient top surface onto which coins may be fed;

means for rotating said disc to move the coins circumferentially;

a guide plate having a central opening and a lower surface positioned over and closely adjacent to said disc, and wherein said lower surface forms an inner recess having a portion within which coins are free to move radially, and said inner recess extends outwardly from said central opening and has an upper surface, said guide plate forming a spiral recess for receiving coins from said inner recess, said spiral recess having an inlet which opens into said inner recess and a pair of opposed walls extending outwardly from said inlet for guiding coins therebetween outwardly toward the outer periphery of the guide plate, the upper surface of said inner recess being adjacent said inlet of said spiral recess and extending between said opposed walls, said upper surface being spaced farther from the top surface of said disc than the lowermost surface of said guide plate but closer to the top surface of said disc than the upper surface of any pair of stacked coins carried by said disc.

8. The coin sorter of claim 7 wherein said upper surface of said inner recess that is closer to the top surface of said disc than the upper surface of any pair of stacked coins carried by said disc extends to the inner periphery of said guide plate.

9. The coin sorter of claim 7 wherein the portion of said inner recess in which coins are free to move radially tapers downwardly at the beginning of said upper surface of said inner recess that is closer to the top surface of said disc than the upper surface of any pair of stacked coins carried by said disc.

* * * * *